US008251664B2

(12) United States Patent
Schreiber

(10) Patent No.: US 8,251,664 B2
(45) Date of Patent: Aug. 28, 2012

(54) FAN BLADE FOR A GAS-TURBINE ENGINE

(75) Inventor: Karl Schreiber, Am Mellensee (DE)

(73) Assignee: Rolls-Royce Deutschland Ltd Co KG (DE)

( * ) Notice: Subject to any disclaimer, the term of this patent is extended or adjusted under 35 U.S.C. 154(b) by 1256 days.

(21) Appl. No.: 12/003,245

(22) Filed: Dec. 21, 2007

(65) Prior Publication Data

US 2008/0152506 A1 Jun. 26, 2008

(30) Foreign Application Priority Data

Dec. 21, 2006 (DE) ..... 10 2006 061 916

(51) Int. Cl.
*F01D 5/28* (2006.01)

(52) U.S. Cl. ..... 416/191; 416/193 R; 416/229 A; 416/230; 416/224; 416/226

(58) Field of Classification Search ..... 416/229 R, 416/229 A, 230, 241 A, 224, 226, 190, 191, 416/193 R, 193 A, 196 R, 219 R, 220 R, 416/241 R, 194–195, 248
See application file for complete search history.

(56) References Cited

U.S. PATENT DOCUMENTS

| | | | | |
|---|---|---|---|---|
| 1,862,579 | A * | 6/1932 | Parsons et al. | 416/224 |
| 3,275,295 | A * | 9/1966 | Caldwell et al. | 416/224 |
| 3,752,600 | A * | 8/1973 | Walsh et al. | 416/219 R |
| 3,762,835 | A | 10/1973 | Carlson et al. | |
| 3,799,701 | A | 3/1974 | Rothman | |
| 3,883,267 | A | 5/1975 | Baudier et al. | |
| 4,655,687 | A * | 4/1987 | Atkinson | 416/193 A |
| 5,655,883 | A | 8/1997 | Schilling | |
| 5,672,417 | A | 9/1997 | Champenois et al. | |
| 5,881,972 | A * | 3/1999 | Smith et al. | 416/224 |
| 6,514,045 | B1 * | 2/2003 | Barton et al. | 416/193 A |
| 6,669,447 | B2 * | 12/2003 | Norris et al. | 416/224 |
| 6,832,896 | B1 * | 12/2004 | Goga et al. | 416/191 |
| 6,843,928 | B2 | 1/2005 | Cline | |
| 2004/0184921 | A1 * | 9/2004 | Schreiber | 416/229 R |

FOREIGN PATENT DOCUMENTS

| | | |
|---|---|---|
| DE | 4411679 | 12/1994 |
| DE | 696 25 426 T2 | 9/2003 |
| DE | 60219 116 T2 | 12/2007 |
| EP | 1596036 | 11/2005 |
| GB | 2288441 | 10/1995 |

OTHER PUBLICATIONS

European Search Report dated Apr. 10, 2009 from counterpart application.

* cited by examiner

*Primary Examiner* — Christopher Verdier
(74) *Attorney, Agent, or Firm* — Timothy J. Kilma; Shuttleworth & Ingersoll, PLC

(57) ABSTRACT

A fan blade for a gas-turbine engine which comprises a supporting structure (2) in fiber-composite material is enclosed by a sheet-metal enveloping structure (4) only in an area of the airfoil (3) such that the loads and stresses acting on the blade root (11), as well as the risk of delamination caused by the high bending load in the transition area between airfoil and blade root, are minimized.

10 Claims, 1 Drawing Sheet

FAN BLADE FOR A GAS-TURBINE ENGINE

Figure 1:
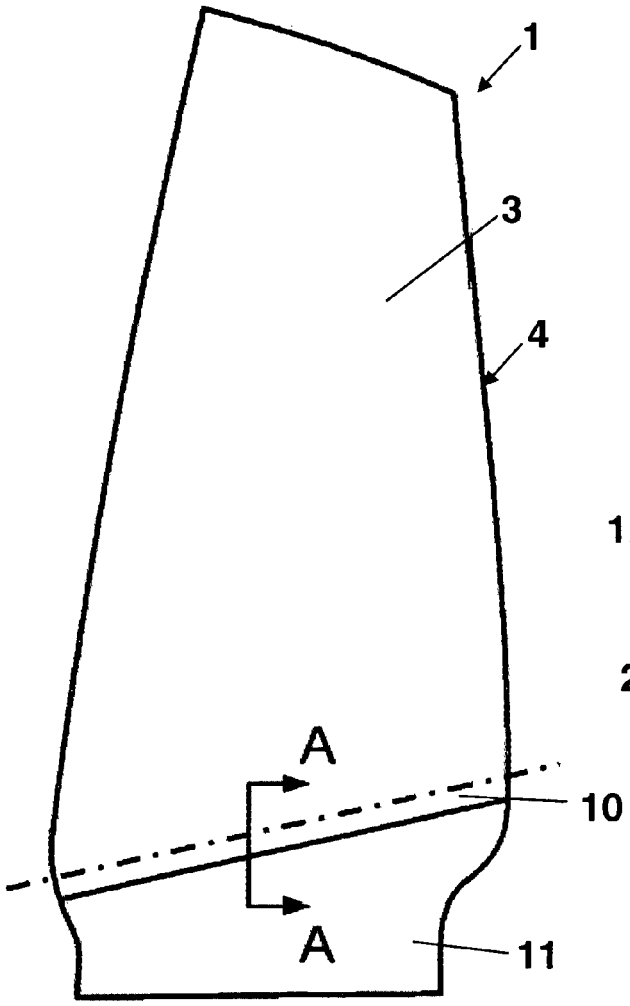

This application claims priority to German Patent Application DE 10 2006 061 916.1 filed Dec. 21, 2006, the entirety of which is incorporated by reference herein.

This invention relates to a fan blade for a gas-turbine engine which includes a supporting structure in fiber-composite material as well as a metallic enveloping structure.

Centrifugal forces, gas pressure and vibrations of the airfoil excited by the flow medium, as well as impinging foreign bodies, subject the fan blades of a fan gas-turbine engine to considerable loads which are also transmitted to the blade root held in slots of the rotor disk.

Fan blades made of fiber-composite material are known which combine relatively low weight with high specific strength and high intrinsic damping to avoid vibrations. For adequate erosion resistance and impact strength against foreign bodies impinging on the blades, the supporting structure in fiber-composite material is enclosed by a metallic enveloping structure.

Due to the complex shape of the blade root, the manufacture of fiber-composite blades provided with an enveloping structure incurs high work and cost investment. Since the tensile forces acting on the sheet-metal enveloping structure are also transmitted to the blade root, the latter is subjected to high loads, with stress and friction at the blade root being increased and life of the blade being reduced. Due to the forces transmitted into the blade root and the high shearing stresses, delamination between the enveloping structure and the supporting structure may occur, particularly since the supporting structure in fiber-composite material and the metallic enveloping structure are connected merely via the infiltration material, which is infiltrated into the fiber material in the enveloping structure, as a result of which optimum bond between the supporting structure and the enveloping structure is not ensured.

A broad aspect of the present invention is to provide fan blades having a supporting structure and an enveloping structure which can be manufactured with low effort and feature a long service-life.

Features and advantageous developments of the present invention will be apparent from the present description.

The present invention provides that the enveloping structure in sheet metal encloses the supporting structure in fiber-composite material only in the area of the airfoil, while the blade root is made of fiber-composite material only. The enveloping structure adjoins, and is flush with, the fiber-composite structure of the blade root shortly beneath the annulus filler. For stress reduction in the transition area to the blade root, it is important here that the rim of the enveloping structure is scarfed and/or provided with regularly spaced recesses. With the enveloping structure confined to the airfoil, tensile forces acting upon the enveloping structure are prevented from being transmitted to the blade root. The high bending load at the transition from the blade root to the airfoil will not lead to the separation of the enveloping structure from the supporting structure. Finally, increased friction between the blade root made of soft material and the metal disk, in which the fan blades are held, provides for reduced wear and improved attachment. For enveloping a pre-manufactured supporting structure, a ductile special adhesive may be applied which ensures improved adhesion and further counteracts the risk of delamination. Thus, a significant increase in service-life can be obtained for a fan blade so formed and manufactured with reduced investment.

The blade is manufactured on the basis of a pre-manufactured supporting structure in fiber-composite material, which is enclosed by the enveloping structure in the area of the airfoil, in that a leading-edge former is welded to a first sheet-metal cover onto which the supporting structure is subsequently adhesively bonded. Then, the second sheet-metal cover is adhesively bonded to the free surface of the supporting structure and joined to the leading-edge former and the trailing edge of the first sheet-metal cover by welding. The second sheet-metal cover is welded to the leading-edge former remotely from the supporting structure to prevent the fiber-composite material from being destroyed by the welding heat.

However, it would also be possible to pre-manufacture the enveloping structure and subsequently produce the supporting structure integrally with the enveloping structure, with the enveloping structure being inserted into a molding tool.

Figure 2:
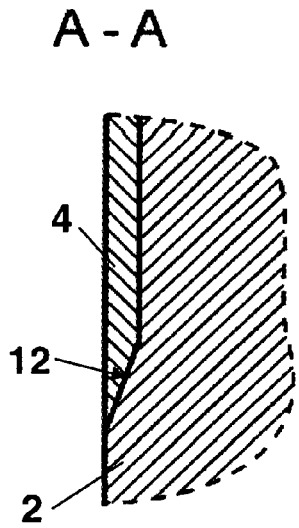
Figure 3:
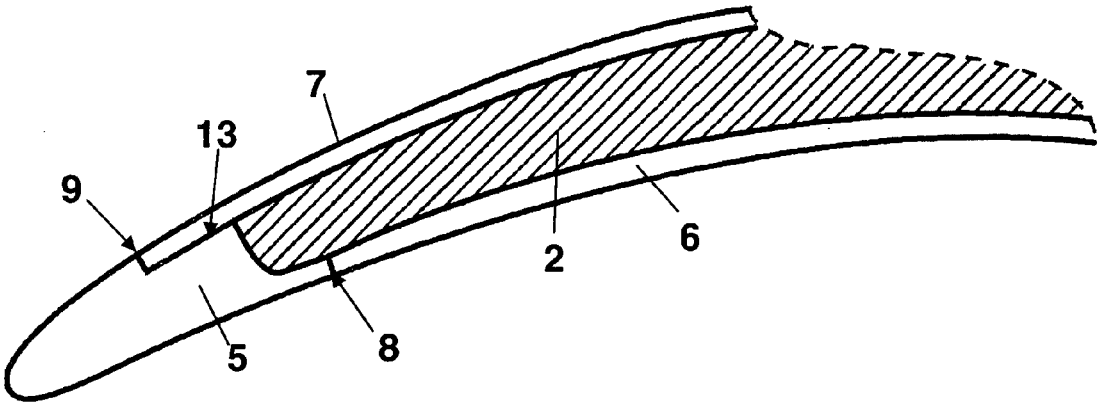

The present invention is more fully described in the light of the accompanying drawings showing a preferred embodiment. In the drawings, FIG. 1 is a side view of a fan blade made of fiber-composite material, with a metallic enveloping structure enclosing the airfoil, FIG. 2 is a sectional view of the transition between enveloping structure and supporting structure along line AA as per FIG. 1, and FIG. 3 is a sectional view in the area of the leading edge of the fan blade as per FIG. 1.

As shown on the drawing, the fan blade 1 includes a supporting structure 2, which is not shown in detail, made of fiber-composite material, here a plurality of carbon-fiber layers arranged on top of each other, with synthetic material infiltrated into the fiber lay-up, and an enveloping structure 4 enclosing the supporting structure 2 in the area of the airfoil 3. The enveloping structure 4 includes a metallic leading-edge former 5 as well as a pressure-side sheet-metal cover 6 and a suction-side sheet-metal cover 7 which, in the present embodiment, are made of a titanium alloy. The two sheet-metal covers 6, 7 are connected to the leading-edge former 5 via the weld joints 8, 9 and to each other at the opposite ends (not shown).

The enveloping structure 4, which only encloses the airfoil 3, ends beneath the so-called annulus filler 10, a blade part which serves for air conduction and damping. The free end of the enveloping structure 4, including sheet-metal covers 6, 7 facing towards the blade root 11 of the fan blade 1, is scarfed, i.e. it features a lower inside edge 12 that is at least one of chamfered or recessed towards the outer surface of the sheet-metal covers 6, 7, with the outer surface of the enveloping structure 4 being in line with the surface of the supporting structure 2 in the area of the blade root 11.

Since the enveloping structure 4 is confined to the airfoil, tensile forces acting on the enveloping structure 4 are not transmitted to the blade root 11. Therefore, the risk of delamination is significantly reduced as the shearing stresses acting on the blade root 11 are only very low. In particular, in the transition area between airfoil 3 and blade root 11, the bending loads occurring there exert high forces which, if the supporting structure is fully enclosed, may lead to delamination between the sheet-metal enveloping structure and the fiber-composite material. Also important in this connection is the scarfed design of the enveloping structure 4 (chamfered edge 12) at the transition to the blade root 11 as it will reduce stress excesses to a minimum extent at this location. In order to further reduce the stresses occurring at the transition point, regularly spaced, for example triangular, recesses (not shown) can be cut circumferentially into the free edge of the enveloping structure 4.

Since the enveloping structure 4 is confined to the airfoil 3, the supporting structure 2 in fiber-composite material can be separately produced in a tool and the enveloping structure 4 subsequently bonded to the supporting structure 2 using a specially selected—ductile—adhesive. The possibility to choose an especially suitable adhesive that is independent of the infiltration material additionally counteracts delamination.

The above mentioned manufacture of the fan blade 1 with the enveloping structure 4 confined to the airfoil 3 using an especially suitable adhesive requires that the fiber-composite material is not damaged by the high welding temperatures occurring during welding of the sheet-metal covers 7, 8 to the leading-edge former 5. Therefore, the leading-edge former 5 is initially connected to the pressure-side sheet-metal cover 6 via the weld joint 8 and the supporting structure 2, which is pre-manufactured in a tool, subsequently bonded to the pressure-side sheet-metal cover 6 and the leading-edge former 5 by the special adhesive. The leading-edge former 5 has a radial recess 13 into which the forward rim of the suction-side sheet-metal cover 7 is fitted such that it is flush and is welded with its forward edge to the leading-edge former 5, actually at a certain distance from the fiber-composite material (weld joint 9). Beforehand, the suction-side sheet-metal cover 7 was bonded to the fiber-composite material of the supporting structure 2 using a ductile special adhesive. The pressure side of the leading edge former can also be recessed to accept the pressure side sheet metal cover. Thus, the leading edge former 5 can have at least one radially extending recess 13 in which at least one of the pressure side or suction side sheet metal covers can be welded. The opposite ends (not shown) of the two sheet-metal covers 6, 7 can be welded at the edges located at a certain distance from the fiber-composite material such that the welding heat does not affect the fiber-composite material.

Basically, it is also possible to pre-manufacture the enveloping structure 4 for the airfoil 3 and fit it in a molding tool and infiltrate the synthetic resin upon lay-up of the fiber material. In this case, the supporting structure can be welded regardless of the fiber-composite material, which is fitted later. However, bonding of the supporting structure to the enveloping structure using the especially suitable adhesive is not possible. Here, the bond is affected by the infiltrated synthetic resin.

A further advantageous effect of the proposed fan blade design is the increase in friction between blade root and rotor disk, actually as a result of the combination of the hard—metallic—material of the rotor disk with the soft fiber-composite material of the blade root. Thus, wear to the blade root is decreased and, on the whole, life of the fan blade, in combination with the effects of the above mentioned features, further increased.

LIST OF REFERENCE NUMERALS

1 Fan blade
2 Supporting structure
3 Airfoil
4 Enveloping structure
5 Leading-edge former
6 Pressure-side sheet-metal cover
7 Suction-side sheet-metal cover
8 Weld joint
9 Weld joint
10 Annulus filler
11 Blade root
12 Chamfered edge, scarfed design
13 Radial recess

What is claimed is:

1. A fan blade for a gas-turbine engine, comprising:
a supporting structure of fiber-composite material;
a sheet-metal enveloping structure;
an airfoil;
a blade root of fiber-composite material; and
an annulus filler in a transition area between the airfoil and the blade root;
wherein the enveloping structure encloses only the airfoil and extends to beneath the annulus filler; the enveloping structure includes a lower edge having at least one of an inside chamfered edge or an inside recessed edge so as to adjoin and be flush with an outer surface of the blade root beneath the annulus filler.

2. A fan blade in accordance with claim 1, wherein the enveloping structure comprises a leading-edge former, a pressure-side sheet metal cover and a suction side sheet-metal cover.

3. A fan blade in accordance with claim 2, wherein the supporting structure is pre-manufactured and bonded to exposed surfaces of the enveloping structure by a ductile adhesive, the leading edge former including a radially extending recess in which at least one of the pressure-side or suction side sheet metal covers is welded, the radially extending recess being positioned at a distance from a rear face of the leading edge former and the fiber-composite material, to avoid direct heat contact with the fiber-composite material during welding of the leading edge former and the sheet metal cover.

4. A fan blade in accordance with claim 2, wherein the enveloping structure is pre-manufactured and the supporting structure is formed within the enveloping structure and bonded to inner surfaces of the enveloping structure by synthetic resin infiltrated into the fiber material of the fiber-composite supporting structure.

5. A fan blade in accordance with claim 1, wherein the enveloping structure is pre-manufactured and the supporting structure is formed within the enveloping structure and bonded to inner surfaces of the enveloping structure by synthetic resin infiltrated into the fiber material of the fiber-composite supporting structure.

6. A fan blade in accordance with claim 5, wherein the at least one of an inside chamfered edge or an edge having at least one recess is an inside chamfered edge.

7. A fan blade in accordance with claim 1, wherein the at least one of an inside chamfered edge or an edge having at least one recess is an inside chamfered edge.

8. A fan blade in accordance with claim 2, wherein the at least one of an inside chamfered edge or an edge having at least one recess is an inside chamfered edge.

9. A fan blade in accordance with claim 3, wherein the at least one of an inside chamfered edge or an edge having at least one recess is an inside chamfered edge.

10. A fan blade in accordance with claim 4, wherein the at least one of an inside chamfered edge or an edge having at least one recess is an inside chamfered edge.

* * * * *